United States Patent [19]

Hiller

[11] Patent Number: 4,676,552

[45] Date of Patent: Jun. 30, 1987

[54] PIECE OF FURNITURE

[76] Inventor: Rolf Hiller, Weinbergstrasse 19, D-7634 Kippenheim 2, Fed. Rep. of Germany

[21] Appl. No.: 645,443

[22] Filed: Aug. 29, 1984

[30] Foreign Application Priority Data

Jul. 26, 1984 [EP] European Pat. Off. ..... 84108831.3

[51] Int. Cl.[4] ..... A47C 1/12

[52] U.S. Cl. ..... 297/445; 297/239; 403/341

[58] Field of Search ..... 297/445, 452, 239; 108/159, 161; 403/341, 403, 231; 52/252, 263, 638

[56] References Cited

U.S. PATENT DOCUMENTS

| | | | |
|---|---|---|---|
| 820,689 | 5/1906 | Wilmont | 297/445 |
| 3,188,693 | 6/1965 | Troyano | 108/161 X |
| 3,765,719 | 10/1973 | Silver | 297/440 |
| 4,119,286 | 10/1978 | Barril | 297/445 X |
| 4,399,754 | 8/1983 | Emery | 108/161 X |

FOREIGN PATENT DOCUMENTS

| | | | |
|---|---|---|---|
| 581423 | 8/1958 | Italy | 403/341 |

*Primary Examiner*—James T. McCall
*Attorney, Agent, or Firm*—Peter K. Kontler

[57] ABSTRACT

A chair with four upright legs, each of which has a single socket, has a square frame assembled of four identical sections each having a straight central portion and two end portions bent outwardly through angles of 135°. The end portions of neighboring sections have abutting toothed surfaces, and each pair of such end portions has a tip of reduced cross section which fits into one of the sockets. The seat on the frame is disposed inwardly of the legs to allow for stacking of several chairs in a small area.

21 Claims, 6 Drawing Figures

PIECE OF FURNITURE

BACKGROUND OF THE INVENTION

The present invention relates to pieces of furniture in general, and more particularly to improvements in pieces of furniture of the type wherein a frame is connected with several legs. Typical examples of such pieces of furniture are tables or chairs.

For the sake of simplicity, the following description of prior art pieces of furniture and of the improved piece of furniture will refer largely to chairs. It will be understood, however, that the invention can be embodied in many other pieces of furniture of the general class having three or more legs and a frame which extends between and is connected to such legs.

It is well known to assemble a wooden chair from three or more legs and from a frame which is connected with the legs and supports the seat. As a rule, or at least in many instances, the frame and the legs are made of wood. The legs may but need not extend upwardly beyond the frame (e.g., two of the legs can extend upwardly to support a back rest), and the frame and/or the legs may but need not be provided with arm rests. In most instances, the frame includes four discrete sections each of which is individually secured to two neighboring legs. For such purpose, each of the legs has two sockets or through holes, and the respective sections of the frame have smaller-diameter end portions constituting or resembling pins or studs which fit into the adjoining sockets. Means can be provided for reducing the likelihood of unintentional withdrawal or expulsion of pins or studs from their sockets.

A drawback of such chairs is that, when a single section of the frame becomes loose, it unduly affects the stability of the entire chair. This is due to the fact that the sections of the frame are not directly secured to each other. Moreover, the making of pairs of sockets or through holes in each of the legs contributes to the cost of assembly and unduly weakens the legs. Attempts to dispose the sockets in each leg at different levels contribute to greater stability of the chair but the cost is not reduced by such distribution of the sockets. An additional drawback of the just described conventional chairs is that they cannot be readily stacked in a small area. This is due to the fact that the legs do not extend outwardly beyond the polygon which is formed by the sections of the frame, i.e., the legs are disposed exactly at the corners of such polygon.

OBJECTS AND SUMMARY OF THE INVENTION

An object of the invention is to provide a novel and improved piece of furniture which does not exhibit the above-enumerated drawbacks of conventional pieces of furniture, which is simpler and sturdier than heretofore known pieces of furniture, and which renders it possible to stack it with identical pieces of furniture in a surprisingly small area.

Another object of the invention is to provide a lightweight piece of furniture, particularly a chair or a table, whose manufacturing cost is a fraction of the cost of the aforediscussed conventional pieces of furniture, and wherein the connections between the frame and the legs are more reliable than in conventional pieces of furniture.

A further object of the invention is to provide a novel and improved method of assembling the frame of a chair or table and of assembling the frame with the legs.

An additional object of the invention is to provide a chair or table wherein each leg must be provided with only a single socket for reception of a portion of the frame.

Still another object of the invention is to provide a novel and improved frame for use in tables, chairs and analogous pieces of furniture.

A further object of the invention is to provide a piece of furniture with three or more legs which embodies the above outlined features and which is of eye-pleasing appearance.

Another object of the invention is to provide novel and improved means for coupling the sections of a frame in a chair, table or other piece of furniture to each other.

The invention is embodied in a piece of furniture, particularly a chair or table, which comprises at least three spaced apart legs each of which has a socket, and a polygonal frame including neighboring elongated sections, one for each of the legs. Each section includes a preferably straight central portion and two end portions which flank and are inclined relative to the central portion. The end portions of neighboring sections form pairs of end portions which are disposed side by side and each such pair of adjoining end portions extends into a different socket. The frame normally consists of wood and its end portions are preferably straight. Each section preferably further comprises two arcuate portions which are disposed between the central portion and the respective end portions, i.e., the transition from the central portion into the end portions is preferably gradual. Means can be provided to bond the end portions of the aforementioned pairs to each other and/or to the surfaces surrounding the respective sockets. Furthermore, the end portions of each pair can be provided with mating teeth to further enhance the stability of the frame and of the entire piece of furniture. The teeth preferably extend longitudinally of the end portions and at right angles to the longitudinal directions of the respective legs.

The pairs of adjoining end portions preferably include tips of reduced cross-sectional area, and such tips are received in the respective sockets. Shoulders which are provided adjacent to and as a result of the making of such tips abut against the external surfaces of the respective legs.

The central portions of the sections constitute the sides of a preferably relatively small first polygon, and the legs are disposed at the corners of a larger second polygon, i.e., the pairs of end portions extend outwardly from the corners of the smaller polygon to the corners of the larger polygon. This renders it possible to stack the improved piece of furniture with similar or identical pieces of furniture in a surprisingly small space. If the number of legs is four, the smaller polygon can constitute a square and each end portion is then preferably bent outwardly at an angle of approximately 135° with reference to the respective central portion. In other words, the pairs of end portions then extend substantially diagonally outwardly from the corners of the polygon which is formed by the central portions of the four sections.

The sections of the frame can constitute solid pieces of wood or each thereof can include several plies which are bonded to each other in a manner known from the making of plywood. Each section can comprise several first plies which extend longitudinally of the respective section and several second plies which extend transversely of the first plies. The number of first plies preferably exceeds the number of second plies.

The arcuate portions can be obtained by subjecting the respective regions of each section to the action of steam.

It is presently preferred to design the sections in such a way that their height is constant or nearly constant all the way from the one to the other end. In other words, the height of the aforementioned tips of the pairs of adjoining end portions need not be less than the height of the central portions.

If the improved piece of furniture is or is to be used as a chair, it further comprises a seat which rests on or is made integral with the sections of the frame, preferably in such a way that the legs are disposed outwardly of the seat.

The length of all end portions is preferably the same.

The novel features which are considered as characteristic of the invention are set forth in particular in the appended claims. The improved piece of furniture itself, however, both as to its construction and the mode of assembling the same, together with additional features and advantages thereof, will be best understood upon perusal of the following detailed description of certain specific embodiments with reference to the accompanying drawing:

DESCRIPTION OF THE PREFERRED EMBODIMENTS

Figure 1:
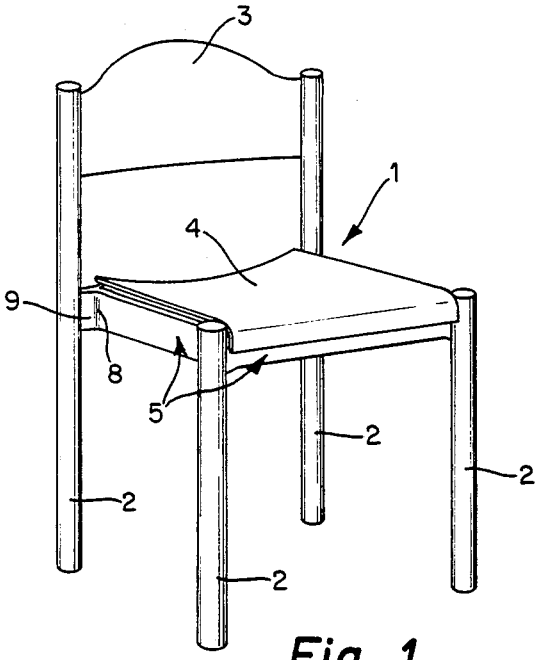
FIG. 1 is a perspective view of a piece of furniture which constitutes a four-legged chair and is constructed and assembled in accordance with one embodiment of the invention.
Figure 2:
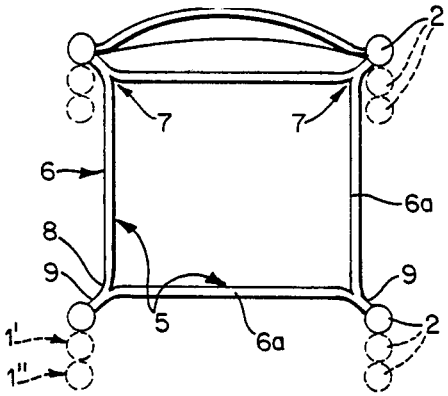
FIG. 2 is a plan view of the chair which is shown in FIG. 1, with the seat omitted.
Figure 3:
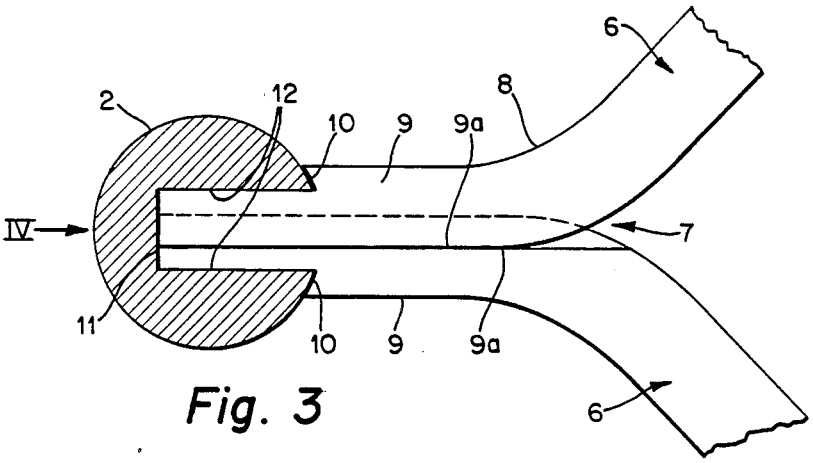
FIG. 3 is a horizontal sectional view of one of the legs and a fragmentary plan view of two neighboring sections of the frame.

The piece of furniture which is shown in FIGS. 1 and 2 is a four-legged chair 1 having two shorter front legs 2, two longer rear legs 2, a back rest 3 between the upper portions of the rear legs 2, a square frame 5 which connects the legs 2 to each other, and a seat 4 which is mounted on or made integral with the frame 5. It is assumed that the legs 2 are made of wood but other materials (such as metal, see FIG. 3) can be used just as well. The frame 5 is made of wood, preferably of four solid pieces of wood. Each such piece constitutes an elongated section 6 and each such section is connected to the two neighboring legs 2. The number of sections 6 in the frame 5 matches the number of legs 2.

The reference characters 7 denote the junctions or joints where the end portions 9 of the sections 6 are connected to each other inwardly of the respective legs 2. Each leg 2 has a single socket 12 in the form of a horizontal blind bore which receives the tip of pairs of adjoining end portions 9 of two neighboring sections 6. Each section 6 further comprises a preferably straight central portion **6*a* and two outwardly bent portions 8 which flank the central portion 6*a* and constitute smooth and gradual transitions from the central portion 6*a* into the respective end portions 9. Such end portions are preferably straight and, since the chair 1 comprises four equidistant legs 2 which are disposed at the corners of an outer polygon, and the central portions 6*a* of the four sections 6 constitute the sides of a smaller inner polygon, the pairs of adjoining end portions 9 extend at angles of approximately 135° from the corners of the inner polygon toward the corners (legs 2) of the outer polygon. This can be readily seen in FIG. 2**.

The adjoining end portions 9 of each pair of neighboring sections 6 have abutting surfaces **9*a* which are preferably bonded to each other by a suitable adhesive and which are preferably provided with mating horizontal teeth 13 which are disposed at different levels, which extend longitudinally of the respective end portions 9, and which are normal or nearly normal to the longitudinal directions of the respective legs 2**.

The tips of the pairs of adjoining end portions 9 are formed by removing some material from the sides of such end portions so as to form shoulders 10 which abut against the external surfaces of the corresponding legs 2. The end faces 11 of the tips of the pairs of adjoining end portions 9 abut against the bottom surfaces in the respective sockets 12. The height of each section 6 is preferably constant from end to end, i.e., all the way between the bottom surfaces in the sockets 12 of the corresponding pair of legs 2. It has been found that the just discussed grouping of end portions 9 into pairs of adjoining end portions, the provision of adhesive on the abutting surfaces **9*a*, the provision of teeth 13 on such surfaces 9*a*, and the aforediscussed mode of inserting the tips of the adjoining end portions 9 into the respective sockets 12 contribute significantly to stability, sturdiness and longer useful life of the improved chair. Each of the aforementioned tips is preferably a tight fit in the respective socket 12**.

Figure 5:
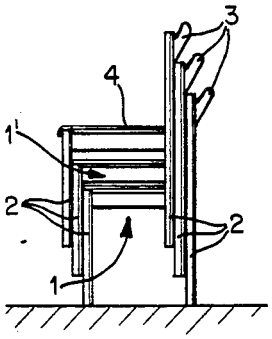
FIG. 5 is a smaller-scale side elevational view of three stacked chairs.

The length of the end portions 9 can be selected within a rather wide range, depending on the desired contour of the chair 1. Thus, and looking at FIG. 2, it will be readily appreciated that the dimensions of the polygon whose sides are formed by the central portions **6*a* of the sections 6 can be reduced by the simple expedient of reducing the length of the central portions 6*a* and increasing the length of the end portions 9 so as to ensure that the polygon whose corners are defined by the four legs 2 is much larger than the polygon whose sides are defined by the central portions 6*a*. Such design of the frame 5 renders it possible to stack any desired practical number of identical chairs 1 in a very small space. As shown in FIGS. 2 and 5, the stacking is carried out in such a way that the rear legs of a second chair 1' (such rear legs are indicated by broken-line circles) are disposed immediately in front of the rear legs of the chair 1 (which places the front legs of the second chair 1' immediately in front of the front legs 2 of the chair 1). The third chair 1'' (FIG. 2) is stacked with the chairs 1 and 1' in an analogous way whereby the floor space requirements of the stack are surprisingly small. Of course, in order to facilitate such stacking, it is necessary to remove the seats 4 (if the seats extend outwardly beyond the sections 6 of the frame 5) or to select the dimensions of the seats 4 (at least at the sides) in such a way that the legs of several chairs 1, 1', 1'', etc. can be arrayed in a manner as shown in FIG. 2, i.e., the rear legs 2 of the chairs 1' and 1'' are outwardly adjacent to the two lateral sections 6 of the frame 5 shown in FIG. 2**.

The aforedescribed orientation and distribution of teeth 13 on the neighboring surfaces 9*a* of the end portions 9 is desirable and advantageous because it contributes to greater stability of the assembled chair. The teeth 13 assist the frame 5 in taking up pronounced transversely acting forces.

Figure 6:
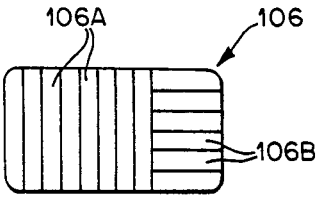
FIG. 6 is a sectional view of one section of the improved frame which is made of multiple-ply material and wherein the distribution of plies enhances the stability of the frame.
Figure 4:
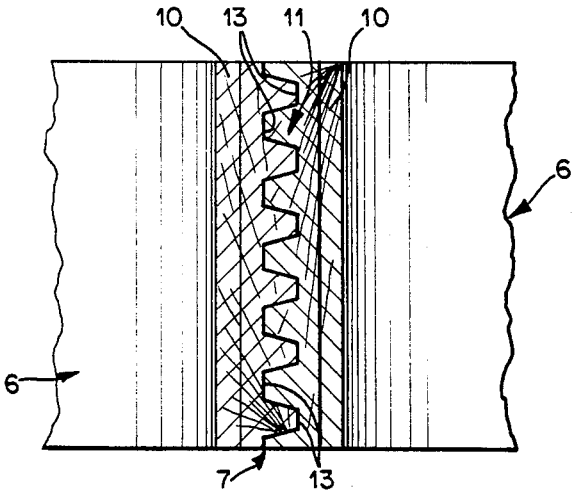
FIG. 4 is a view substantially as seen in the direction of arrow IV in FIG. 3, with the leg omitted.

FIG. 6 shows that each section 106 of the improved frame can be assembled of several plies including first plies 106A extending longitudinally of the respective section 106 and second plies 106B which are inclined relative to the plies 106A. The number of plies 106A can exceed the number of plies 106B. The manner in which the plies 106A and 106B are bonded to each other is known from the art of making of plywood.

An important advantage of the improved piece of furniture is its simplicity. Thus, each of the legs 2 must be provided with only a single socket 12, at least for the purpose of securing it to the frame 5, and the sections 6 or 106 of the frame are secured to the respective legs 2 as well as to each other which evidently enhances the stability of the frame and of the entire piece of furniture.

The making of teeth 13 (if such teeth are provided at all) does not contribute significantly to the cost of the frame because the material of the sections 6 or 106 is wood. The exact configuration of the teeth 13 can be selected practically at will, as long as such teeth can properly mate and contribute to stability of the frame by resisting at least some stresses which are transmitted from the legs to the frame and/or vice versa. The configuration of teeth 13 may resemble that of the teeth which are normally provided on pieces made of wood or the like. At least in some instances, mere bonding of the abutting surfaces 9*a* will suffice to impart to the frame 5 the required stability, especially in view of the fact that the tips of the end portions 9 extend into the respective sockets 12 and that such end portions are provided with shoulders which abut against the external surfaces of the respective legs 2.

Symmetrical arrangement of pairs of adjoining end portions 9 (for example, so that they extend diagonally from the square inner polygon as shown in FIG. 2) is desirable and advantageous because this also contributes to the stability of the piece of furniture. However, it is clear that the improved frame can be used with equal advantage in chairs or tables having three, five or more legs as well as in many other pieces of furniture which have three or more legs and frames serving to rigidly connect such legs to one another.

If the sections 6 or 106 are made of wood, the arcuate portions of each section can be formed subsequent to exposure of corresponding portions of the sections 6 or 106 to the action of steam. If the sections (106) are laminated, the end portions of such sections can be suitably bent with reference to the corresponding central portions during the assembly of plies. The feature that the number of longitudinally extending plies 106A exceeds the number of transversely extending plies 106B also contributes to greater stability of the assembled piece of furniture. Thus, the section 106 is less likely to bend and it offers a surprisingly high resistance to deforming stresses acting thereon in a large number of different directions.

An additional important advantage of the improved piece of furniture is its stability. Thus, the legs are not weakened to the same extent as heretofore because it suffices to provide each leg with a single socket 12. Moreover, the provision of outwardly bent straight end portions 9 contributes to stability of the frame because the sections of the frame are secured to the legs as well as to each other. The aforediscussed additional features, such as the possibility of stacking a large number of chairs 1 in a manner as shown in FIGS. 2 and 5, also enhance the utility of the improved piece of furniture. The provision of shoulders 10 contributes to the ability of the frame and/or legs to stand pronounced stresses, and such shoulders allow for more predictable and desirable transmission of forces between the legs and the frame. Finally, the improved frame is of eye-pleasing appearance. If desired, the frame can be dimensioned and mounted in such a way that it is not visible at all or that it is barely visible when the seat 4 is in place.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A piece of furniture, particularly a chair, comprising two substantially straight front legs and two substantially straight rear legs, each of said legs having a lower end and a socket spaced apart from the lower end; and a polygonal seat-supporting frame including four elongated neighboring sections each including a central portion and two end portions flanking and outwardly inclined relative to the respective central portion, the end portions of neighboring sections forming pairs of adjoining end portions which together form a Vee and are disposed side by side and have mating teeth, each pair of adjoining end portions extending into one of said sockets and said legs being devoid of any connections with one another between said lower ends and said sockets thereof, those pairs of adjoining end portions which extend into the sockets of the rear legs providing room for the rear legs of a second piece of furniture when identical first and second pieces of furniture are stacked so that the front and rear legs of the second piece of furniture are located in front of the front and rear legs of the first piece of furniture and the frame of the second piece of furniture is located on top of or close to the frame of the first piece of furniture.

2. The piece of furniture according to claim 1, wherein said frame consists of wood and the central portions of said sections are at least substantially straight.

3. The piece of furniture according to claim 1, wherein said end portions are straight and each of said sections further comprises two arcuate portions disposed between the central portion and the respective end portions.

4. The piece of furniture according to claim 1, further comprising means for bonding the end portions of said pairs to each other.

5. The piece of furniture according to claim 1, wherein the central portions of said sections constitute the sides of a relatively small first polygon and the legs constitute the corners of a larger second polygon, said pairs of end portions extending outwardly from the corners of said first polygon.

6. The piece of furniture according to claim 1, wherein the end portions of each section make with the respective central portion angles of approximately 135°.

7. The piece of furniture according to claim 6, wherein said frame is a square frame and said pairs of end portions extend substantially diagonally outwardly from the respective central portions toward and into the sockets of the respective legs.

8. The piece of furniture according to claim 1, wherein said sections are solid pieces of wood.

9. The piece of furniture according to claim 1, wherein said sections include plies of wood.

10. The piece of furniture according to claim 9, wherein each of said sections comprises several first plies extending longitudinally of the respective section and several second plies extending transversely of the respective first plies.

11. The piece of furniture according to claim 10, wherein the number of first plies in each of said sections exceeds the number of second plies.

12. The piece of furniture according to claim 1, wherein each of said sections consists of or contains wood and further includes two arcuate portions interposed between the central portion and the respective end portions, such arcuate portions being formed by subjecting the corresponding regions of the sections to the action of steam.

13. The piece of furniture of claim 12, wherein said sections constitute solid pieces of wood.

14. The piece of furniture according to claim 1, wherein said teeth extend transversely of the respective legs.

15. The piece of furniture according to claim 14, wherein said teeth extend longitudinally of the respective end portions and are disposed above each other.

16. The piece of furniture according to claim 1, wherein the height of each of said sections is at least substantially constant from end to end.

17. The piece of furniture according to claim 1, further comprising a seat provided on said frame, said legs being disposed outwardly of said seat.

18. A piece of furniture according to claim 1, wherein the length of all of said end portions is the same.

19. The piece of furniture according to claim 1, comprising a support having a load-bearing surface, said support being carried by said frame.

20. The piece of furniture according to claim 19, wherein said central portions of said end portions are at least substantially straight, each of said sections further comprising two bend portions disposed between the central portion and the respective end portions.

21. The piece of furniture according to claim 20, wherein said frame consists essentially of wood and the end portions of each pair are adhesively bonded to one another.

* * * * *